US008919042B2

(12) United States Patent
Vaknin et al.

(10) Patent No.: US 8,919,042 B2
(45) Date of Patent: Dec. 30, 2014

(54) KIT FOR MOTORIZED CLOSURE ASSEMBLY

(71) Applicant: New Vision Yezirot Aluminum Ltd., Even Yehuda (IL)

(72) Inventors: Oren Vaknin, Netanya (IL); Yoav Rodan, D.N. Bikat Beit Hekerem (IL); Giora Silne, Karmiel (IL)

(73) Assignee: Slider Next Vision Ltd., Netanya (IL)

( * ) Notice: Subject to any disclaimer, the term of this patent is extended or adjusted under 35 U.S.C. 154(b) by 0 days.

(21) Appl. No.: 13/956,026

(22) Filed: Jul. 31, 2013

(65) Prior Publication Data

US 2014/0047768 A1 Feb. 20, 2014

Related U.S. Application Data

(63) Continuation-in-part of application No. 13/589,873, filed on Aug. 20, 2012.

(51) Int. Cl.
*E05F 11/00* (2006.01)

(52) U.S. Cl.
USPC ..... 49/358

(58) Field of Classification Search
USPC ..... 49/358, 360, 404, 425
See application file for complete search history.

(56) References Cited

U.S. PATENT DOCUMENTS

| | | | | |
|---|---|---|---|---|
| 3,331,428 | A * | 7/1967 | Ford | 160/331 |
| 3,468,061 | A | 9/1969 | Kazuyoshi | |
| 4,672,773 | A * | 6/1987 | Bilt | 49/358 |
| 4,754,572 | A * | 7/1988 | Bilt | 49/358 |
| 5,546,706 | A * | 8/1996 | Coupet | 49/420 |
| 6,298,520 | B1 * | 10/2001 | Blickhahn et al. | 16/71 |
| 6,581,332 | B1 * | 6/2003 | Kim | 49/358 |
| 6,588,153 | B1 | 7/2003 | Kowalczyk | |
| 8,381,445 | B2 * | 2/2013 | Hans | 49/316 |
| 8,474,185 | B2 * | 7/2013 | Busch | 49/358 |
| 2007/0271850 | A1 * | 11/2007 | Mickelson | 49/358 |
| 2010/0227738 | A1 | 9/2010 | Henderson | |
| 2011/0225885 | A1 | 9/2011 | Van Tassell | |
| 2012/0110911 | A1 * | 5/2012 | Heng et al. | 49/358 |
| 2012/0192490 | A1 * | 8/2012 | McCaslin | 49/31 |
| 2012/0272576 | A1 * | 11/2012 | Van Tassell et al. | 49/70 |

FOREIGN PATENT DOCUMENTS

WO WO 2012/096647 A1 7/2012

* cited by examiner

*Primary Examiner* — Jerry Redman
(74) *Attorney, Agent, or Firm* — Blue Filament Law PLLC; Avery N. Goldstein

(57) ABSTRACT

A motorized closure assembly is provided that includes an opening frame configured to fit around the opening; a substantially rectangular closure slab having a closure slab frame configured to surround the substantially rectangular closure slab and sealingly fit within the opening frame; and a motorized driver, wherein the motorized driver is entirely embedded within the closure slab frame or within a combination of the closure slab frame and the opening frame, the motorized driver configured to slidably move the slab between an open position and a closed position.

19 Claims, 10 Drawing Sheets

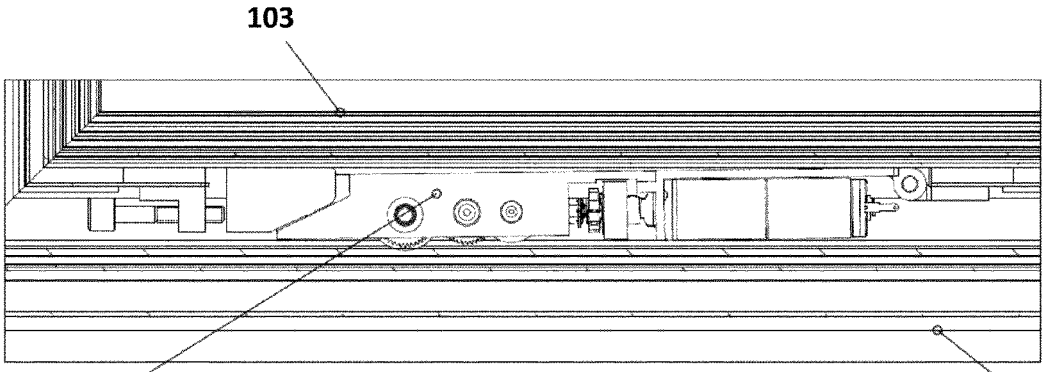
FIG. 1C
FIG. 2B
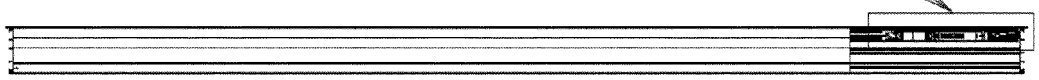
FIG. 2A
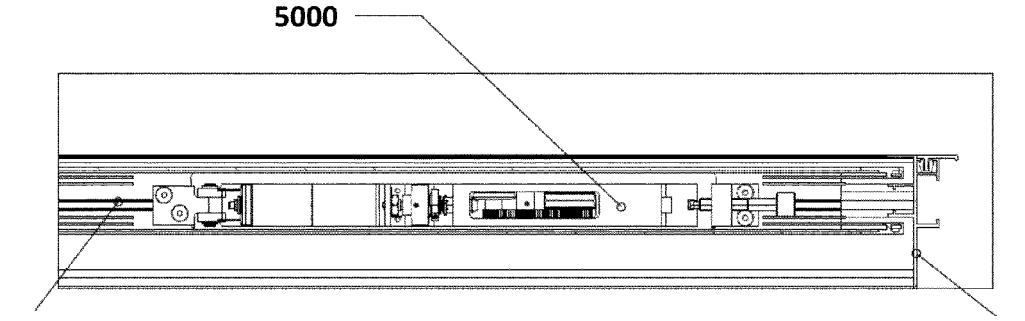
FIG. 2B

KIT FOR MOTORIZED CLOSURE ASSEMBLY

RELATED APPLICATIONS

This application is a continuation-in-part of U.S. Utility application Ser. No. 13/589,873 filed Aug. 20, 2012; the contents of which are hereby incorporated by reference.

BACKGROUND

The disclosure is directed to motorized closure assembly. Specifically, the disclosure is directed to kits enabling motorizing sliding windows and doors.

Building doors and windows include a number of different types of designs such as overhead doors and windows, horizontal sliding doors and windows, vertical lift doors and windows, folding doors and windows, pocket doors and windows, roller doors and windows etc. With space for buildings and apartments getting increasingly small, so does the space available for any driving mechanisms configured to open and close these doors and windows.

Additionally, safety and aesthetic considerations impose design restrictions making commonly used externally visible and accessible drive mechanisms undesirable.

Accordingly, there is a need for concealed drive mechanisms for doors.

SUMMARY OF THE INVENTION

In an embodiment, provided is a kit for enabling slidably moving a closure slab between an open position and a closed position, the kit comprising: a drivetrain comprising a leveling assembly and a mobilizing assembly, wherein the mobilizing assembly comprises: a driver; optionally a clutch; a gear box; and a track wheel coupled to the gear box, the track wheel configured to engage a rail; a locking assembly comprising: a locking mechanism comprising: a MEMS device comprising a faceplate, the faceplate defining an elongated horizontal slot; a housing coupled to the face plate, the housing defining an access bore spanning the width of the housing; a bolt slidably coupled to the housing within the access bore; optionally, a locking pin operably coupled to the bolt, the locking pin extending through the access bore beyond the housing; a connector operably coupled to the bolt; a solenoid, configured to engage a forward actuator and a backward actuator in response to a signal, the solenoid operably coupled to the connector; a forward and backward actuators operably coupled to the housing; and a manual override tab operably coupled to the connector extending through the horizontal slot in the faceplate; and a strike plate, configured to engage the locking pin with a vertically elongated elliptical channel defined therein, wherein the locking mechanism capable of communicating with a command and control module; command and control module, comprising an internal control panel; the internal control panel comprising: a user interface; a processor; a sensor configured to detect a user's motion, wherein the user's motion is operable to provide a signal; and optionally a transceiver, wherein the control panel is configured to communicate with the drivetrain, the locking assembly, or both; optionally packaging; and optionally instructions.

In another embodiment, provided herein is a drivetrain for a motorized closure assembly, comprising: a leveling assembly; and a mobilizing assembly, wherein the mobilizing assembly comprises: a driver; a clutch; a gear box; and a track wheel coupled to the gear box, the track wheel configured to engage a rail.

In another embodiment, provided herein is a locking assembly comprising: a locking mechanism comprising: a MEMS device comprising a faceplate, the faceplate defining an elongated horizontal slot; a housing coupled to the face plate, the housing defining an access bore spanning the width of the housing; a bolt slidably coupled to the housing within the access bore; optionally, optionally a locking pin operably coupled to the bolt, the locking pin extending through the access bore beyond the housing; a connector operably coupled to the bolt; a solenoid, configured to engage a forward actuator and a backward actuator in response to a signal, the solenoid operably coupled to the connector; a forward and backward actuators operably coupled between the housing and the solenoid; and a manual override tab, operably coupled to the connector extending through the horizontal slot in the faceplate; and a strike plate, configured to engage the bolt, or optionally the locking pin within a vertically elongated elliptical channel defined therein, wherein the locking assembly is capable of communicating with a control panel.

In yet another embodiment, provided herein is a control panel; the control panel comprising: a user interface; a processor; a sensor configured to detect a user's motion, wherein the user's motion is operable to provide a signal; and optionally a transceiver, wherein the control panel is configured to communicate with a drivetrain, a locking assembly, or both.

BRIEF DESCRIPTION OF THE DRAWINGS

The features of the motorized opening closure kits and components described will become apparent from the following detailed description when read in conjunction with the drawings, which are exemplary, not limiting, and wherein like elements are numbered alike in several figures and in which:

FIG. 1A shows an illustration of an opening comprising three motorized panes according to another embodiment of the technology where, FIG. 1C shows a second drivetrain according to an embodiment of the technology;

FIGS. 2A and 2B, show a cut-away illustration of the first drivetrain in relation to the closure slab frame (FIG. 2A), magnified in FIG. 2B, according to an embodiment of the technology;

Figure 1B:
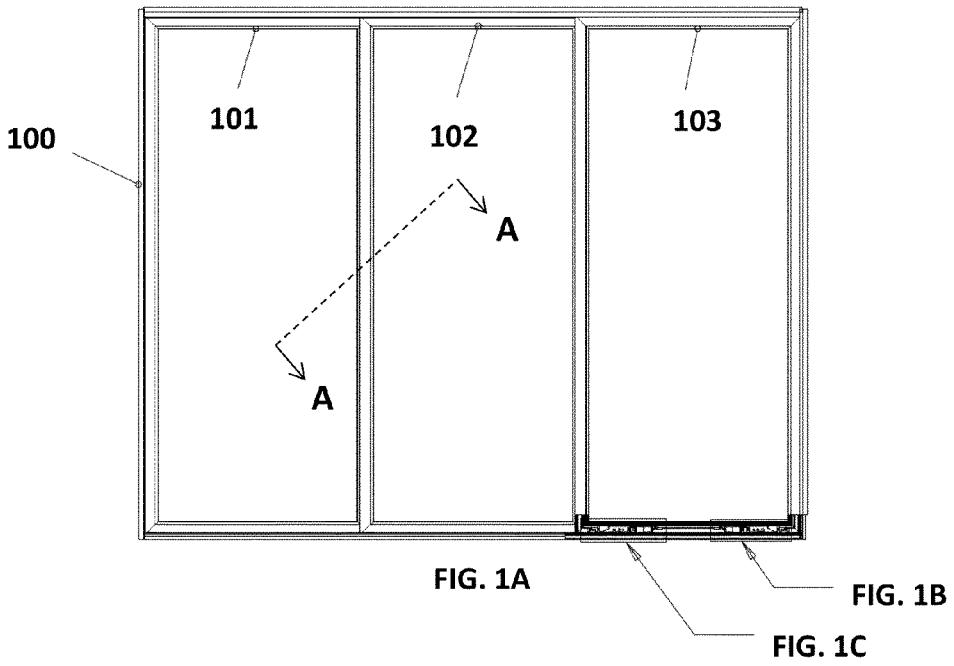
FIG. 1B shows a first drivetrain.

While the disclosure is amenable to various modifications and alternative forms, specifics thereof have been shown by way of example in the drawings and will be further described in detail hereinbelow. It should be understood, however, that the intention is not to limit the disclosure to the particular embodiments described. On the contrary, the intention is to cover all modifications, equivalents, and alternatives.

DETAILED DESCRIPTION OF THE PREFERRED EMBODIMENTS

The disclosure relates in one embodiment to motorized closure assembly kits and components. In another embodiment, the disclosure relates to kits and kit components enabling motorizing sliding windows and doors. Accordingly, provided herein are motorized closure assemblies and kits, comprising a drivetrain, a locking mechanism, a control panel, packaging material, and instructions.

Detailed embodiments of the present technology are disclosed herein; however, it is to be understood that the disclosed embodiments are merely exemplary, which can be embodied in various forms. Therefore, specific structural and functional details disclosed herein are not to be interpreted as limiting but merely as a basis for the claims and as a representative basis for teaching one skilled in the art to variously employ the present invention in virtually any appropriately detailed structure. Further, the terms and phrases used herein are not intended to be limiting but rather to provide an understandable description of the invention.

The terms "first," "second," and the like, herein do not denote any order, quantity, or importance, but rather are used to denote one element from another. The terms "a", "an" and "the" herein do not denote a limitation of quantity, and are to be construed to cover both the singular and the plural, unless otherwise indicated herein or clearly contradicted by context. The suffix "(s)" as used herein is intended to include both the singular and the plural of the term that it modifies, thereby including one or more of that term (e.g., the film(s) includes one or more films). Reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be present in other embodiments. In addition, it is to be understood that the described elements may be combined in any suitable manner in the various embodiments.

In addition, for the purposes of the present disclosure, directional or positional terms such as "top", "bottom", "upper," "lower," "side," "front," "frontal," "forward," "rear," "rearward," "back," "trailing," "above," "below," "left," "right," "horizontal," "vertical," "upward," "downward," "outer," "inner," "exterior," "interior," "intermediate," etc., are merely used for convenience in describing the various embodiments of the present disclosure.

In an embodiment, provided herein is a kit for enabling the slidable motorized motion of a slab between an open and a closed position comprising: a drivetrain comprising a leveling assembly and a mobilizing assembly, wherein the mobilizing assembly comprises: a driver; optionally a clutch; a gear box; and a track wheel coupled to the gear box, the track wheel configured to engage a rail; a locking assembly comprising: a locking assembly comprising: a MEMS device comprising a faceplate, the faceplate defining an elongated horizontal slot; a housing coupled to the face plate, the housing defining an access bore spanning the width of the housing; a bolt slidably coupled to the housing within the access bore; optionally, a locking pin operably coupled to the bolt, the locking pin extending through the access bore beyond the housing; a connector operably coupled to the bolt; a solenoid, configured to engage a forward actuator and a backward actuator in response to a signal, the solenoid operably coupled to the connector; a forward and backward actuators operably coupled to the solenoid and the housing; and a manual override tab operably coupled to the connector extending through the horizontal slot in the faceplate; and a strike plate, configured to engage the bolt or locking pin with a vertically elongated elliptical channel defined therein, wherein the locking mechanism capable of communicating with the command and control module; a command and control module (CCM), comprising: an internal control panel; the internal control panel comprising: a user interface; a processor; a sensor configured to detect a user's motion, wherein the user motion is operable to provide a signal; optionally a transceiver, wherein the CCM is configured to communicate with the drivetrain, and/or the locking assembly; optionally packaging; and optionally instructions.

In another embodiment, the drivetrain used in the kits described are configured to be concealed with the slab frame or portion thereof.

As used herein, "concealed" means that any cable, wiring, and drivetrain are sufficiently enclosed or embedded within the opening frame and/or the slab frame such that, in the normal and typical use of the motorized closure, the user does not typically come into contact with and/or get entangled in, and/or may observe the drivetrain. Thus, the term "concealed" does not necessarily mean that the drivetrain is completely hidden from view when the motorized closure slab is in use in the closed position. Rather, the drivetrain may be slightly/partially visible, but it is sufficiently recessed within and covered by the closure slab frame in normal use. The term "embedded" refers to the drivetrain, the driver, and the locking assembly, being coupled firmly within a surrounding structure, or enclosed snugly or firmly within a material or structure, for example, the closure slab frame, the pane frame or the opening frame and their combination.

The term "coupled", including its various forms such as "operably coupled", "coupling" or "coupleable", refers to and comprises any direct or indirect, structural coupling, connection or attachment, or adaptation or capability for such a direct or indirect structural or operational coupling, connection or attachment, including integrally formed components and components which are coupled via or through another component or by the forming process. Indirect coupling may involve coupling through an intermediary member or adhesive, or abutting and otherwise resting against, whether frictionally or by separate means without any physical connection.

The opening where the motorized closure (e.g., window, or door) is to be installed using the kits described can be substantially rectangular or square. For example, an opening for a door or a window and the like. The substantially rectangular opening can have an aspect ratio with a longitudinal axis that is longer than a traverse axis. The longitudinal axis can be parallel with the closure sliding direction or perpendicular to the sliding direction. The closure slab or panes can have a top and bottom horizontal planes and proximal and distal vertical planes. The vertical distal plane defines the plane closest to the opening frame (in other words, the sill) in the closed position, while the vertical proximal plane defines the planes closest to the opening frame in the open position.

The slab can be opaque or have see-through clarity. "See-through clarity" as used herein refers to an easiness with which a target can be visually recognized through the slab and can be specified by total luminous transmittance and/or parallel luminous transmittance. As used herein, the see-through clarity is described to become lower as the luminous transmittance decreases. "See-through" encompasses any characteristic that allows visual inspection through the slab. Specifically, a viewing window, or the entire slab may be translucent, transparent, or entirely clear. "Translucent" indicates that light can pass through the slab, but the light is diffused. It does not require that a whole surface or an article itself is transparent and portions of the article may be transparent or opaque, for example to serve a function or to form a decorative pattern. The term "translucent" as used herein can refer to a slab composition that transmits at least 60% of electromagnetic radiation in the region ranging from 250 nm to 700 nm with a haze of less than 40%. The slab composition can also have a transmission of at least 75% for example, specifically at least 85%. Additionally, the slab composition can have a haze of less than 40% for example, specifically, a haze of less than 10%, more specifically a haze of less than 5%. The term "translucent" can also refer to a composition capable of at least about 40% transmission of light. The light referred to can be, e.g., actinic light (e.g., from a laser), emitted light (e.g., from a fluorochrome), or both, or transmittance of at least 80%, more preferably at least 85%, and even more preferably at least 90%, as measured spectrophotometrically using water as a standard (100% transmittance) at 690 nm. Likewise, "transparent" refers to a slab composition capable of at least 70% transmission of light.

The opening can be in a wall or defined between structural beams. The opening frame can be coupled to the opening, defining an opening frame, or a sill. For example, the opening frame can be comprised of a horizontal upper support beam, a lower horizontal guide rail and two vertical posts (in other words, jambs). The horizontal upper support beam can be coupled to the opening upper boundary, or to a ceiling beam and the like. The lower horizontal guide rail can be coupled to the floor.

The opening frame, and/or the closure slab frame (in other words, the slab frame and/or the frame surrounding the panes) can be made of the same or different material and can be any appropriate material, for example resin (thermoplastic or thermoset), or wood, or metal, or, for example aluminum or a combination comprising at least one of the foregoing, and/or their composites. Methods of forming the frame or parts thereof can be through extrusion molding, injection molding, thermoforming and the like. Likewise, the opening frame used in motorized closures described can be configured to accommodate a single slab or a plurality of slabs, or panes (slabs and panes are used interchangeably in an embodiment). Also, the closure slab (in other words, a window or a door without the attached frame), can be surrounded by a closure slab or closure pane frame that is configured to receive the motorized driver assemblies described herein.

A sliding window, door or the like, as described herein can have at least two panes which extend in a generally vertical plane and at least one of which is movable generally horizontally, an opening frame (in other words, a sill) can include a channel that extends generally horizontally and within which bottom horizontal edge portions of each of the at least two panes are received, a dividing member within the channel which extends between the at least two panes, the dividing member extending either in contact with or in close facing relationship with the bottom edge portions of the at least two panes. The bottom of the channel in the opening frame can further include a rail extending generally horizontally and within which bottom edge portions of each of the at least two panes are engaged and slide upon. In another example, the pane frame can include a complementary channel configured to receive the rail. The pane can for example be an inner pane or an outer pane, referring to the relative position of the panes to the interior of the structure.

Pocket door systems have become an increasingly preferred door system in the construction of residential and commercial building structures in which room space is limited. The pocket door system can include a header assembly having a track on which trolley assemblies are slidably coupled for translational movement. A door can be suspended from the trolley assemblies and is, therefore, capable of movement between a closed position and an open position wherein, in the open position, the door can be concealed within a pocket formed in the surrounding wall structure. Such a door system offers the advantage over standard hinged door arrangements in that dedication of floor space is not required to open the door from a closed position. The kits used to enable motorized closure assemblies as described herein can be used for example to impart motion to pocket doors.

The slab or combination of panes, can seal the opening when in the closed position. The term "sealingly" as used herein is to be interpreted as substantially impeding airflow, moisture, particulates and the like though the junction and or opening. Accordingly, the panes, or the closure and opening frame abut against each other without substantial gaps so that air inside the structure does not exchange freely with air outside, thereby avoiding heat loss by means of air currents passing around the walls.

The term "pane" is used principally to embody a glass sheet, which may or may not be a framed sheet. However, the term "pane" is not restricted to glass sheet and may for example include any transparent or opaque material, such as polycarbonate (transparent) or timber (opaque). The term is also intended to encompass double glazed units of two or more sheets of glass or other suitable material. In an embodiment, not all panes are motorized. For example, a closure opening can be closed with three panes have three independent pane frames wherein, only the external and mid panes are motorized with the assemblies, while the internal pane is not motorized. Closure slabs, or panes, motorized with the assemblies described herein can have a weight of up to 400 Kg, for example, between 5.0 Kg to 400 Kg, or 5.0 Kg to 300 Kg, specifically, between 5.0 Kg to 250 Kg, or between 120 Kg and 250 Kg, more specifically between 75 Kg and 200 Kg or between 100 Kg to 220 Kg.

The motorized driver used for sliding the panes along the path in the disclosure provided, can be a DC motor (direct current) or an AC motor (alternating current). The driver (in other words, a mechanical power transfer device) can also be a servo motor, an electric motor, a pneumatic motor and/or any other suitable electrical, mechanical, magnetic or other motor or driver that can apply a torque force upon a drive shaft operably coupled to the track wheel. The driver can be configured to turn in two directions, namely clock-wise and counter-clockwise. The driver can be coupled to a gear through a shaft. In addition, the mechanical power transfer device can further comprise: a gear box, a clutch (electromagnetic, mechanical, pneumatic or other suitable clutch mechanisms), drive shaft, brackets, and other components capable of assisting in power transfer from a motor to the drivetrain.

The slab or panes can be slidably coupled to the opening frame (or, in other words the sill). The driver can be configured to slidably move the panes or slab along the appropriate track on the opening frame (in other words, the sill) at speeds of, for example, between 5.0 to 100 cm/sec., specifically, between 5.0 to 60 cm/sec., or between 5.0 to 30 cm/sec., more specifically, between 5.0 to 25 cm/sec., or between 5.0 to 15 cm/sec. The term "slidably coupled" is used in its broadest sense to refer to elements which are coupled in a way that permits one element to slide or translate with respect to another element.

Figure 14:
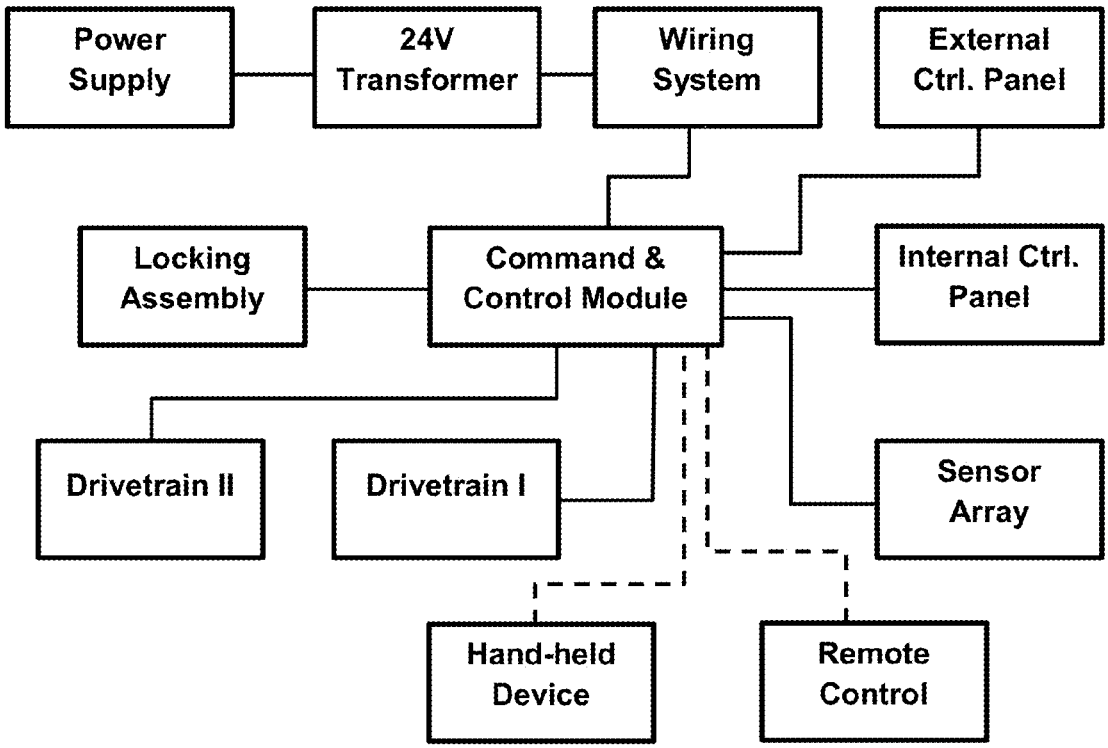
FIG. 14, shows a schematic illustrating the CCM's interaction with the locking assembly and the drivetrain.

Initiation of motion in any of the motorized closure assemblies can be done once the command and control module (CCM, or, in other words the control panel) has verified that any locking means are disengaged (see e.g., FIG. 14). For example, a locking means comprising a pin wherein the pin is electromagnetically actuated between a recessed position within the closure slab or pane frame and an open position protruding outside of the closure slab or pane frame, and inserted into the opening frame and/or an adjacent pane frame, can be actuated by the CCM. Prior to initiation of motion of the motorized closure assemblies described, the CCM verifies that the locking pin is in the recessed position, if the pin is in the recessed position, then the motion of the closure slab or pane using the assemblies described herein will be initiated. Else, the pin can be recessed and motion initiated or an alert can be provided to the user. In an embodiment, the CCM is a component in the kits provided herein.

Figure 11:
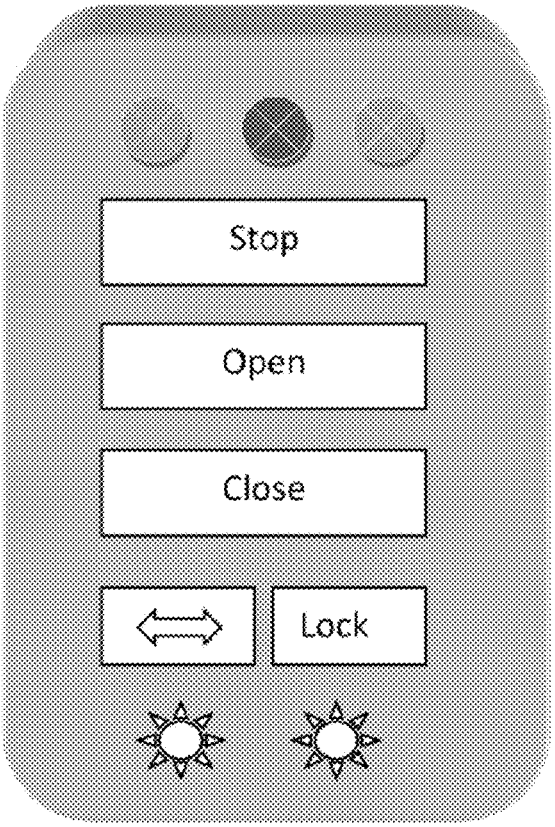
FIG. 11, shows an embodiment of the internal control panel.
Figure 12:
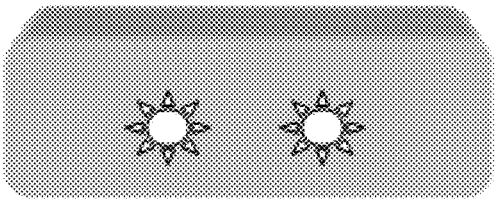
FIG. 12, shows and embodiment of the external control panel.
Figure 13:
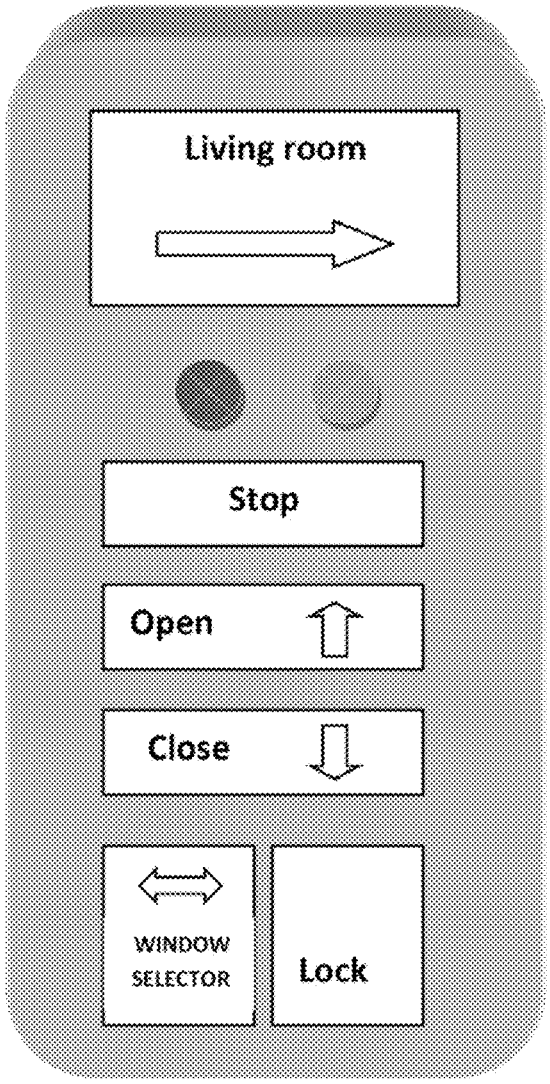
FIG. 13, shows and embodiment of a remote control (RC) for the command and control module (CCM)

The command and control module may comprise several components, for example, an internal control panel, and external control panel, and a remote control. The internal control panel can be mounted on the internal window pane, facing the inside of the structure. The internal control panel may further comprise a user interface that can have several buttons, for example, "open", "close", "lock", and a direction button. The internal control panel may further comprise a sensor configured to sense a gesture or motion of a user. The motion/gesture sensor can be configured to enable opening and closing of the window in accordance with the direction of the motion in one embodiment, as well as sensing the speed of the motion across the sensor and translating that speed to varying the opening or closing speed of the window. The gesture/motion sensors can also be configured to stop the motion of the window during the process of closing or opening, by, for example, placing the hand in a stationary position for a predetermined period (e.g., about 1-2 seconds). In addition, other proximity sensors can be incorporated into the window panes, for example magnets and the like. In certain embodiments, the internal control panel used in the kits provided herein, which can be a touch-screen, does not have any other buttons or functionality actuators except the motion/gesture sensors and locking/unlocking functionality can be achieved using hand motions across the sensors. For example, by varying the time period where the hand is stationary across the sensors, placing a hand across a single sensor, both sensors and the like. As shown in FIGS. 11 and 12, the control panel can comprise two or more sensors; however, these figures should not be limiting and are exemplary.

There can be a larger number of gesture/motion sensors, or in an example, a touch screen slider, capable of sensing direction, speed and time when the motion is stationary, leading to the desired functionality. Additionally, in an embodiment, the touch screen will depict a slide bar that can have the same functionality as the sensors. Sliding direction can be illustrated and controlled on the slide bar, stopping at any given point and locking either by either maintaining touch at the closed position or by double-tap the slide bar arrow. In an embodiment the slider portion of the bar can be green, indicating indicate open or closed (red slider) pane. Likewise, the bar slider could be configured such that double tap, or locking will not be done unless the slider is red.

The internal control panel may further comprise indicator lights, for example light emitting diodes (LEDs), where, in certain embodiments, Left Solid green,—indicating the locking assembly is open, as well as indicating direction for opening—left to right and a Right Solid green same indication, with direction of motion being right to left. A Solid red can indicate the locking assembly is locked. Also, flashing red and green—failed—details, error number will appear on, for example, the remote control (RC) display screen.

In certain circumstances, additional biometric authentication devices can be incorporated to the internal control panel such as, for example, fingerprint scanner, voice template microphone, retinal scanner and the like. The authentication data, as well as other executable commands associated with the internal control panel can be placed on a memory module operably communicating with a processor disposed within the internal control panel.

Figure 10:
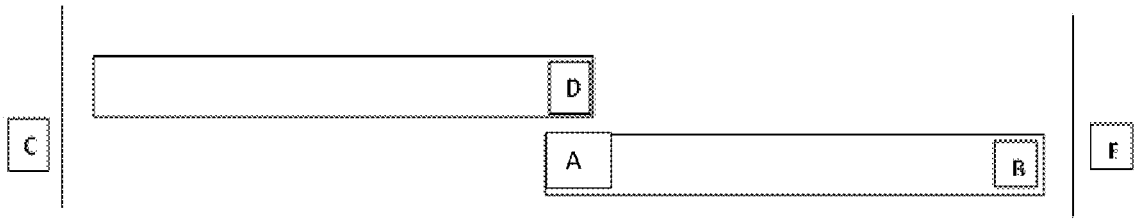
FIG. 10, shows a schematic of the locking assembly installed within a two-pane closure.

In an embodiment, the internal control panel can be placed along the vertical frame section of the internal pane, away from the opening frame. (See e.g., location "A" in FIG. 10). As shown in FIG. 10, only one window pane (or door) is motorized and includes the internal control panel [A] and external control panel [B]. The external control panel [B] is shown as an example in FIG. 12 and may comprise the gesture/motion sensors described herein.

The CCM may further comprise a remote control (RC) configured to communicate with the internal control panel. Communication between the RC and the internal control panel can b, for example, via RF and the like. The RC may comprise: a Display Screen having a size 30×15 mm for example, and will be capable of displaying the opening direction by a direction arrow. Likewise, any system fault, can be displayed on the screen. In addition, the name of the window being controlled can be displayed on the screen (which room and other user-defined description). The RC may also comprise Launch Buttons (e.g., Direction Replacement (long press) \ window selector (short press), Open, Close, Stop, and Lock). Also, indicator LEDs can be incorporated as indicated above (e.g., Solid green—an open locking mechanism, Solid red—a closed locking mechanism, and Off and On flashing red and green—failure (details \ error number can be displayed on the screen). The remote control can be a touch-screen, and/or an application on a handheld device such as a smart phone, tablet computer, iPad and the like.

The internal control panel can be configured to maintain communication with the locking mechanism and the drivetrain. In any window/door/closure there can be two wings or more. As described, the operating internal control panel can be located on the inside of the front wing facing the internal space of the opening. The external control panel (e.g., the panel comprising the gesture/motion sensors) can be located on the outside of the vertical frame, for example, back-to-back with the inner operating panel. When designing the window, it may be beneficial to take into account the window/door pane most likely to be the one moving and install the internal operating panel to be more accessible for opening and closing.

The CCM, locking assembly and drivetrain can be wired to receive a DC voltage—e.g., 6V, 12V, 18V or 24V—from a structure grid or transformer, with a power supply and wiring connected thereto. The CCM, locking and drivetrain assemblies may also be connected to accommodate voltages that are standard in commercial, residential and industrial lighting distribution systems—e.g., 110V, 240V, 460V—to permit the components to easily be installed.

In an embodiment, provided herein is a kit for motorizing a closure slab as described herein. The kit can comprise a drivetrain, a locking assembly, a command and control module, optionally packaging, and optionally instructions. The drivetrain used in the kits described can comprise a leveling assembly and a mobilizing assembly, wherein the mobilizing assembly comprises: a driver; optionally a clutch; a gear box; and a track wheel coupled to the gear box, the track wheel configured to engage a rail. The drivetrain can be any of the drivetrains described herein.

The locking assembly can comprise: a locking mechanism comprising: a MEMS device comprising a faceplate, the faceplate defining an elongated horizontal slot; a housing coupled to the faceplate, the housing defining an access bore spanning the width of the housing; a bolt slidably coupled to the housing within the access bore; optionally, a locking pin operably coupled to the bolt, the locking pin extending through the access bore beyond the housing; a connector operably coupled to the bolt and to a solenoid; a solenoid, configured to engage a forward actuator and a backward actuator in response to a signal, the solenoid operably coupled to the connector; a forward and backward actuators disposed between the solenoid and the housing; and a manual override tab operably coupled to the connector extending through the horizontal slot in the faceplate; and a strike plate, configured to engage the locking pin having a vertically elongated elliptical channel defined therein, wherein the locking mechanism capable of communicating with the command and control module.

The term "MEMS device" (Micro-Electro-Mechanical Systems) as may be used in this application refers in an embodiment to a device integrating micro-scale mechanical elements, sensors, actuators, and electronics on a common silicon substrate formed using microfabrication technology, which that includes a micromachined component having some features or clearances with sizes in the micrometer range, or smaller (i.e., smaller than about 10 microns). It should be noted that if components other than the micromachined component are included in the MEMS device, these other components may be micromachined components or standard sized (i.e., larger) components.

In an embodiment, the strike plate can be mounted on one slab frame such that the locking mechanism will latch one closure slab frame to another closure slab frame, and not, as is typically done, to a door jamb or the frame covering the opening (in other words the opening frame), thus creating a solid slab from all panes in the closure, sealingly closing the opening. In other embodiment, the strike plate can be mounted on the opening frame in a way that would prohibit the slidable motion of the slab or pane relative to the opening frame.

In an embodiment, the kits used to motorize a closure slab or pane can comprise a drivetrain for a motorized closure assembly, comprising: a leveling assemble; and a mobilizing assembly, wherein the mobilizing assembly comprises: a driver; a clutch; a gear box; and a track wheel coupled to the gear box, the track wheel configured to engage a rail. The rail can be disposed, for example, within a channel in the horizontal frame base, configured to receive the closure slab frame or pane frame, extending the length of the channel.

The kits used to enable the assembly of motorized closure, can further comprise: an opening frame or part thereof, configured to fit around the opening; a substantially rectangular closure slab having a closure slab frame configured to surround the closure slab and sealingly fit within the opening frame can comprise a first drivetrain embedded within and operably coupled to the closure slab frame or pane frame. The leveling assembly can comprise an adjustment screw, threaded through an adjustment screw bracket coupled to attachments means configured to couple the leveling assembly to the closure slab frame or the pane frame. The tip of the adjustment screw opposite the screw head can be configured to have channels extending perpendicular to the longitudinal axis of the adjustment screw, configured to slidably couple in a groove defined in the posterior end of a leveling assembly. The leveling assembly can have a beveled anterior end (in other words, creating a wedge), configured to slidably couple to an oppositely slanted mobilizing assembly posterior end, such that turning the adjustment screw will cause the leveling assembly to slide between a bottom surface of the closure slab frame or the pane frame, and the mobilizing assembly, causing the closure slab frame or the pane frame to lift in relation to the rail, thus changing its height. The mobilizing assembly can be hingedly coupled to the closure slab frame or the pane frame at the anterior end. The motorized systems described herein can have a first and a second drivetrains embedded within and operably coupled to the closure slab frame or the pane frame.

Figure 3:
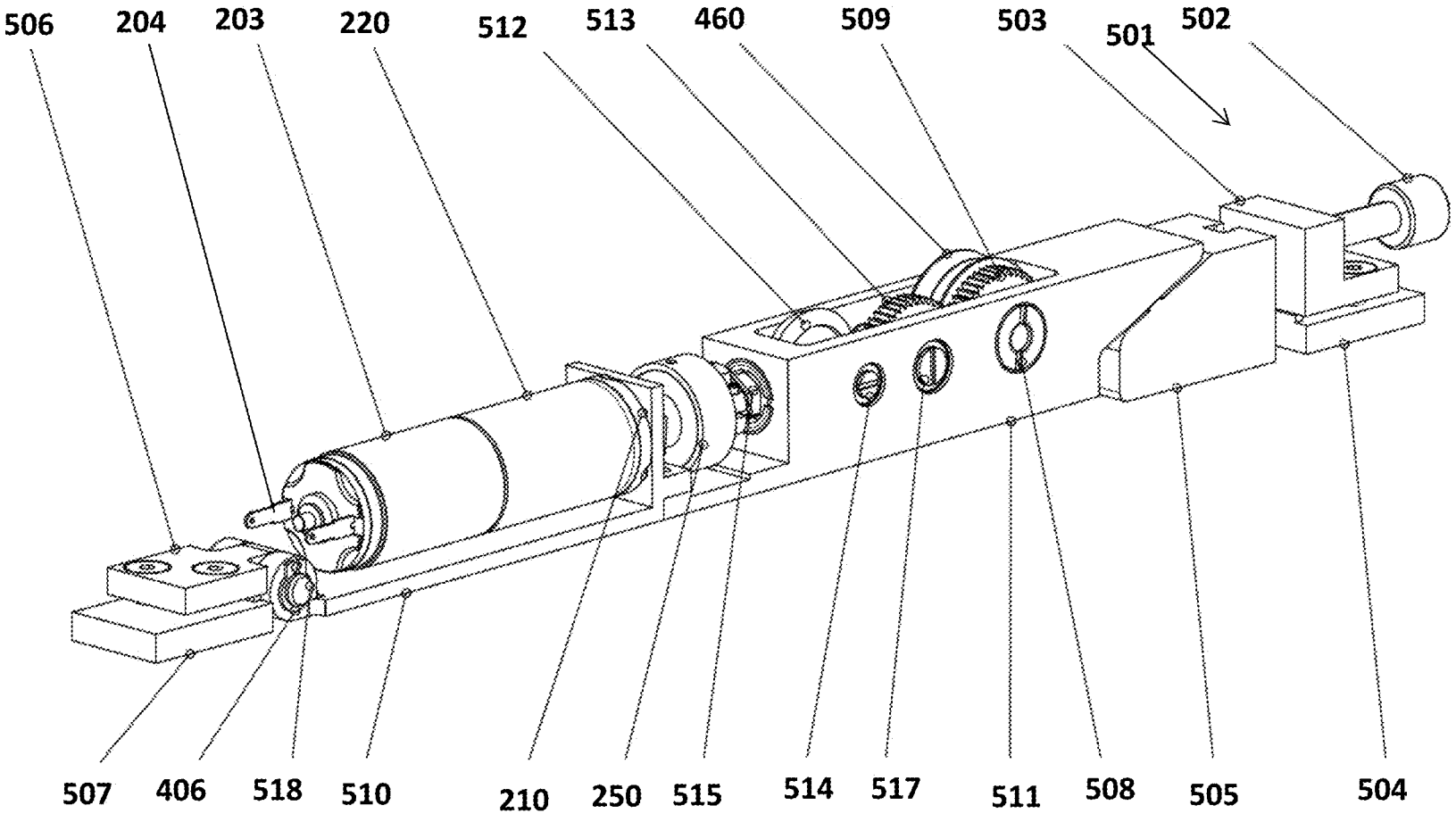
FIGS. 3-5 show various views of an inventive of a drivetrain according to an embodiment of the technology: an isometric view (FIG. 3), a side view (FIG. 4) and a top view (FIG. 5)
Figure 4:
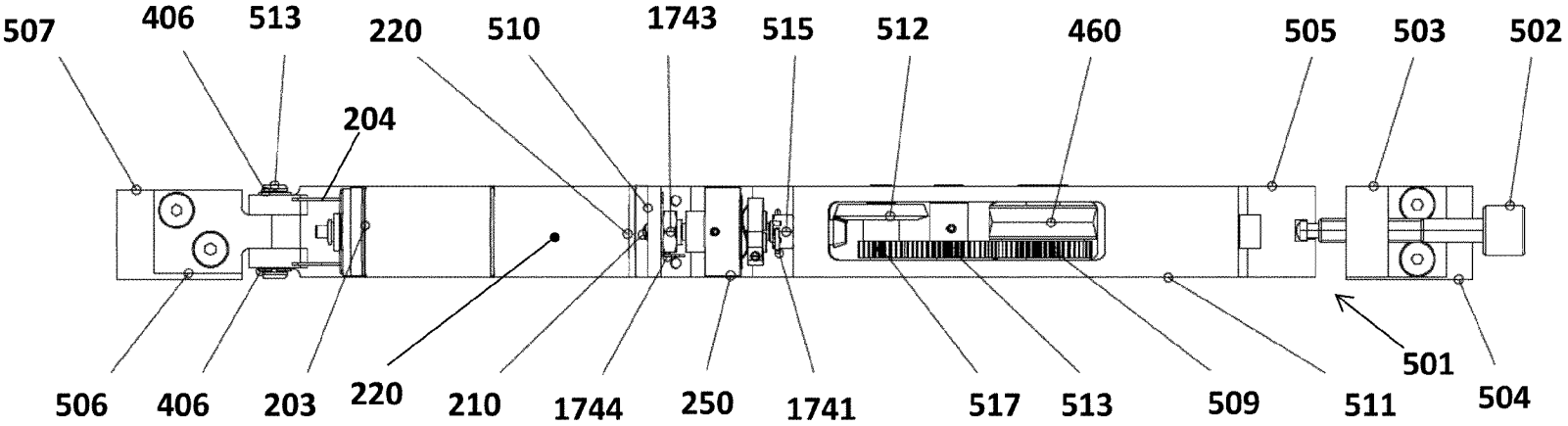
Figure 5:
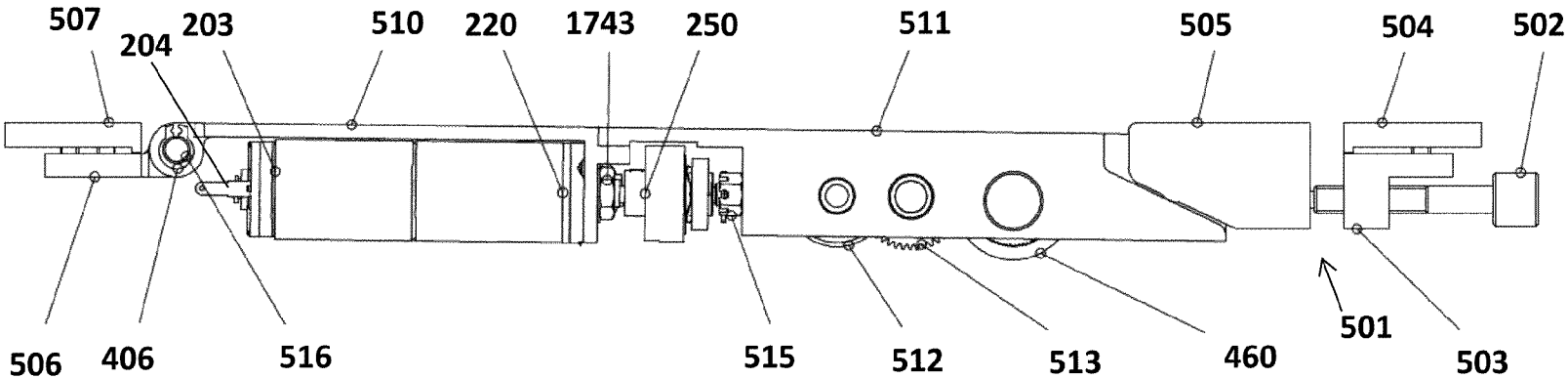

The first and second drivetrain can comprise a driver; a clutch; a gear box, a track wheel the track wheel configured to engage a rail on the closure frame (or in other words, the sill). The gearbox can comprises, for example, a beveled gear; and at least one spur gear, wherein the at least one spur gear is operably coupled to the track wheel, the track wheel configured to engage a rail on the opening frame. The gear assembly (or gear box) can also include the elements such as shown in FIGS. 3-5 and/or can include any other suitable gears, pulleys, belts, chains and/or any other drive element know to those skilled in the art of power transmission, such as to transfer driving forces from a driver to a driven element (for example, the track wheel).

The term "drivetrain" is used in its broadest sense to refer to the combination comprising the leveling assembly, the adjustment screw, the adjustment screw bracket and frame coupling means, the driver motor, the driveshaft, the transmission assembly, the clutch, the housing and the slab attachment means and the track wheel. However, other elements, such as the bottom part of the slab or pane frame can be a part of the drivetrain. In a specific example, the number and location of the drivetrain can be varied and be between 1 and 4 drivetrain assemblies, located for example, along the bottom horizontal plane of the closure slab or closure pane or at the top plane of the closure slab or closure pane. Upon receipt of a command from a command and control module (CCM), in electronic communication with the drivetrain(s), when, for example, two drivetrain assemblies are coupled to the closure slab frame or closure pane frame, movement of the first drivetrain in one direction can be initiated.

Upon power failure or selection by a user on the CCM, the clutch, for example, an electromagnetic clutch can disengage the driver motor from the gear box, allowing for manual opening or closing of the slab or pane. It would be recognized that a similar clutch can be disposed between the drive shaft of the driver motor and the driver pulley described in the assemblies provided throughout this disclosure, enabling the same operations.

The drivetrain assembly used in the kits provided herein can be located at the top plane of the pane closure, moving the track wheel along a shelf in the opening frame such that the track wheel and the gear assembly hangs on the rail attached on the shelf in the sill. The drivetrain can further comprise coupling means to operably couple the drivetrain to the closure slab or pane frame. The coupling means can comprise hinges, attachment members and the like, which may be used to attach the drivetrain to the frame of the closure slab or pane. In a specific example, a pane frame having a profile that can be configured retroactively to receive the drivetrain disclosed herein is provided with a drivetrain as described herein, thereby enabling the pane to move upon receipt of a command from a control module.

The control panel, namely, the command and control module used in the kits described herein can comprise a user interface; a processor; a sensor configured to detect a user gesture (or in other words, a hand motion by the user), wherein the user gesture is operable to provide a signal; and optionally a transceiver, wherein the control panel is configured to communicate with the locking assembly, and/or the drivetrain.

As used herein, "communicate" (and its derivatives e.g., a first component "communicates with" or "is in communication with" a second component) and grammatical variations thereof are used to indicate a structural, functional, mechanical, electrical, optical, or fluidic relationship, or any combination thereof, between two or more components or elements. As such, the fact that one component (e.g., the CCM) is said to communicate with a second component (e.g., the locking assembly) is not intended to exclude the possibility that additional components (e.g., sensors) can be present between, and/or operatively associated or engaged with, the first and second components.

The term "engage" and various forms thereof, when used with reference to retention of a member, refer to the application of any forces that tend to hold two components together against inadvertent or undesired separating forces (e.g., such as may be introduced during use of either component). It is to be understood, however, that engagement does not in all cases require an interlocking connection that is maintained against every conceivable type or magnitude of separating force. Also, "engaging element" or "engaging member" refers to one or a plurality of coupled components, at least one of which is configured for releasably engaging a locking pin.

A more complete understanding of the components, processes, assemblies, and devices disclosed herein can be obtained by reference to the accompanying drawings. These figures (also referred to herein as "FIG.") are merely schematic representations (e.g., illustrations) based on convenience and the ease of demonstrating the present disclosure, and are, therefore, not intended to indicate relative size and dimensions of the devices or components thereof and/or to define or limit the scope of the exemplary embodiments. Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

FIG. 1A illustrates an embodiment of the location of the drivetrain mechanism included in the kits described herein, showing side view of opening frame 100 where three panes, internal pane 101, mid pane 102 and external pane 103 are enclosed by pane frame. Cut-away points to corresponding detailed drawings in FIGS. 1B and 1C. As shown in FIG. 1B, a first drivetrain assembly 5000 is located within pane frame 103 and rollingly riding on track defined in opening frame (sill) 100 with the drivetrain having a proximal end coupled to the right plane of pane frame 103. FIG. 1C, shows a second drivetrain assembly 5000 located within pane frame 103 and rollingly riding on track defined in opening frame (sill) 100 with the drivetrain having a proximal end coupled to the left plane of pane frame 103.

Turning now to FIGS. 2A and 2B, a bottom view of opening frame 100 with a cut away showing drivetrain 5000 is shown, further detailed in FIG. 2B.

Turning now to FIGS. 3-5, showing various aspects of drivetrain 5000. An isometric view is shown in FIG. 3, where drivetrain 5000 is comprised of a leveling assembly 501 and a mobilizing assembly. Leveling assembly 501 can comprise pad lock screw 502 threaded into pad lock bracket 503 coupled to pad lock base 504, where pad lock screw having a distal end having channels etched thereto in a direction perpendicular to the longitudinal axis of pad lock screw 502 configured to fit within a complimentary groove in height adjustment wedge 505. Pad lock base 504 is configured to couple to closure slab frame or pane frame 103.

Height adjustment wedge 505 having a beveled anterior end can be slidably coupled to (e.g. abut against) mobilizing assembly base 511, having an oppositely slanted posterior end, such that turning pad lock screw 502 will cause the leveling wedge to slide between a bottom surface of closure slab frame or pane frame 103, and the proximal end of mobilizing assembly base 511, lifting or lowering closure slab frame or pane frame 103 in relation to the rail (not shown). Mobilizing assembly base can house a gear box, comprising a first spur gear 509, wherein the spur gear can have involuted teeth either straight or helically cut on its radial surface, which can be configured to engage a second spur gear 513 and wherein the first spur gear is adjacent to a track wheel 460, the track wheel having a radius of between 5 to 25 mm, and extending beyond the surface of assembly base 511. Track wheel 460 having a grooved radial surface configured to engage a rail extending the length of track channel rolling thereon. The first spur gear 509 and the track wheel 460 can be coupled to drivetrain assembly base 511 via a common axle secured to drivetrain assembly base 511 by axle nut 508, while the second spur gear 513 is coupled to drivetrain assembly base 511 via a mid-axle, secured to drivetrain assembly base 511 via mid axle screw. The second spur gear can be configured to engage a third spur gear 517 disposed on a common axle with bevel gear 512, having teeth cut into a conical surface (i.e. a pitch zone). Bevel gear 512, can be meshed together with a conical head attached to drive shaft (not marked) to transmit power between two shafts perpendicular to each other. Beveled driveshaft (not marked) is connected to slip clutch 250 via nut 515. Slip clutch 250 is connected at the opposite end of the beveled driveshaft to a planetary gear box 220 system consisting of one or more outer gears, revolving about a central gear, thereby capable of increasing output speed of the shaft coupled to slip clutch 250. Planetary gearbox 220 can be coupled to drivetrain assembly base 511 via driver connector base 210 with driver motor 203 coupled to planetary gear box 220, and resting against driver flange 510 extending from drivetrain assembly base 511 and terminating in electrical leads 204. Driver flange 510 extending from drivetrain assembly base 511 is coupled to rear axle base 506, hingedly coupled to rear axle screw base 507 via hinge 518, which can be secured with a c-clamp 406. Rear axle screw base 507 is configured to hingedly couple to closure slab frame or pane frame 103, allowing the proximal end of mobilizing assembly base 511 to move freely, vertically lowering and lifting the closure slab frame or pane frame 103 between about 1 and 5 mm. For example, the a first and second drivetrain assemblies comprising the leveling assembly and the mobilizing assembly can be embedded within the lower horizontal pane frame 103, with pad lock screw 502 of the first drivetrain assembly being proximal to left side of pane frame 103 and pad lock screw 502 of the second drivetrain assembly being proximal to the right side of pane frame 103, thus allowing leveling of pane frame 103 through orifices defined in pane frame 103, covered by cover 106 (not shown). Using the CCM, motor revolution can be coordinated.

Figure 1B:
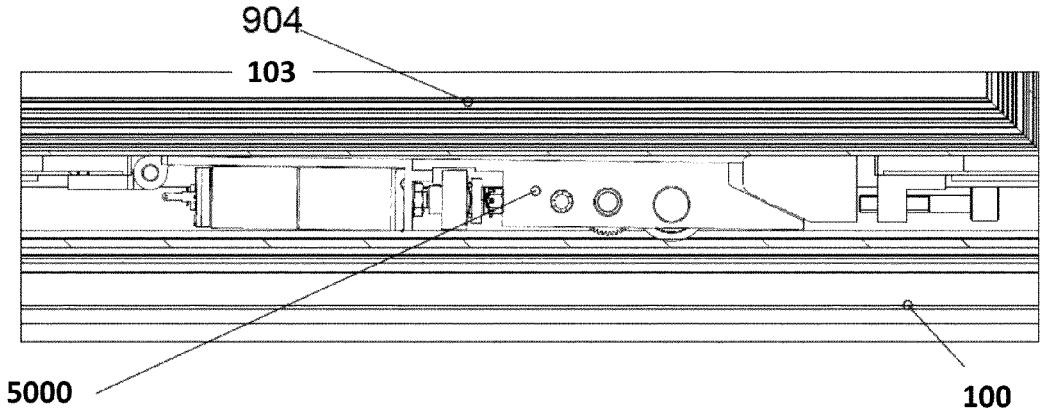
Figure 6A:
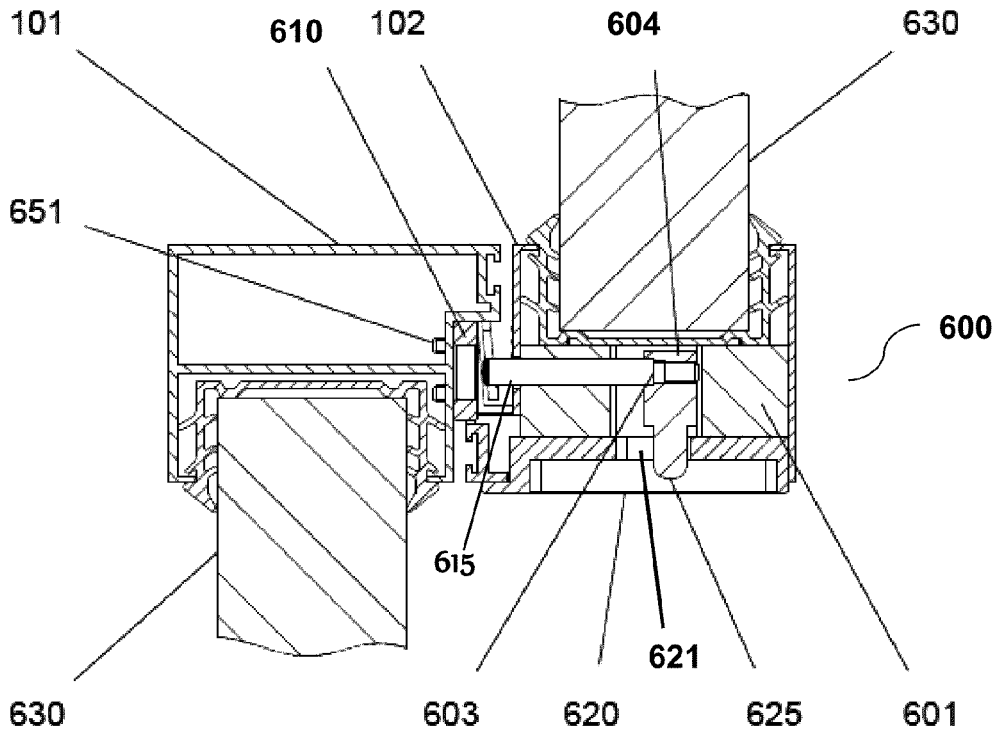
FIGS. 6A and 6B, shows a top view of cross section A-A in FIG. 1 illustrating the locking mechanism in the open position (FIG. 6A) and closed position (FIG. 6B)
Figure 6B:
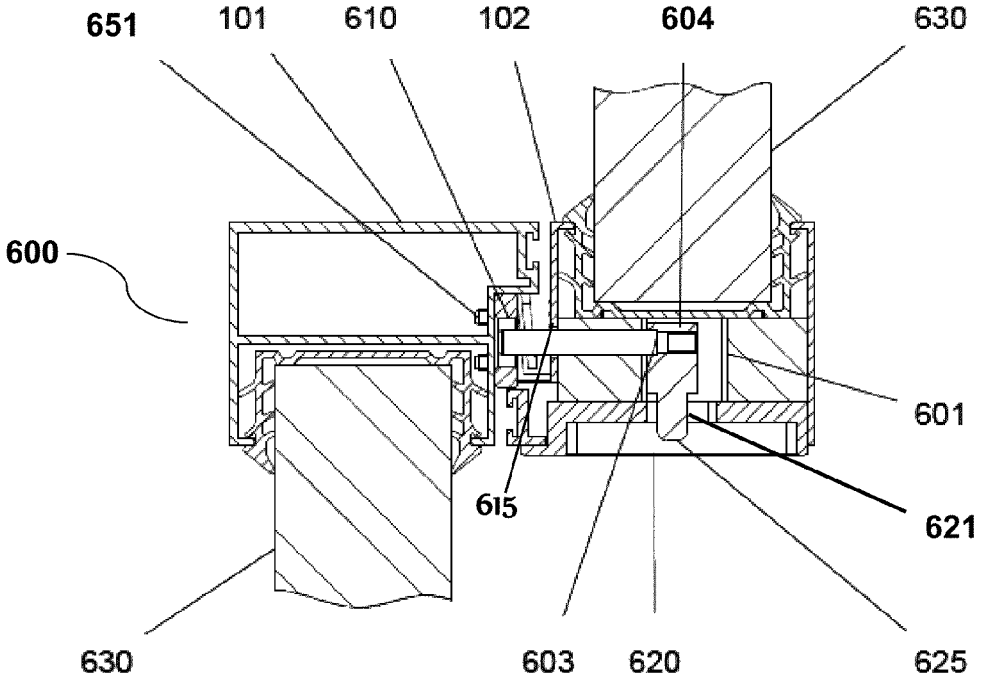

Turning now to FIGS. 6-9, as shown in FIG. 6A, locking assembly 600 disposed in cross section A-A from FIG. 1 in an unlocked position (FIG. 6A) and locked position (FIG. 6B). As shown in FIG. 8B, locking assembly 600 comprises housing 601, access bore 615 spanning the width of housing 601, with bolt 603 slidably coupled to housing 601 disposed within access bore 615. Bolt 603 is coupled to connector member 604, configured to connect solenoid 605 to bolt 603. A locking pin can be optionally coupled to bolt 602 and extend beyond access bore 615 and engage strike plate 610. As shown in FIGS. 6A, 6B, 8A, and 9, manual override tab 625 extends from connector member 604 and is configured to extend beyond slot 621 defined in face plate 620. (See e.g., FIGS. 6A, 6B, 7 and 9)

Figure 7:
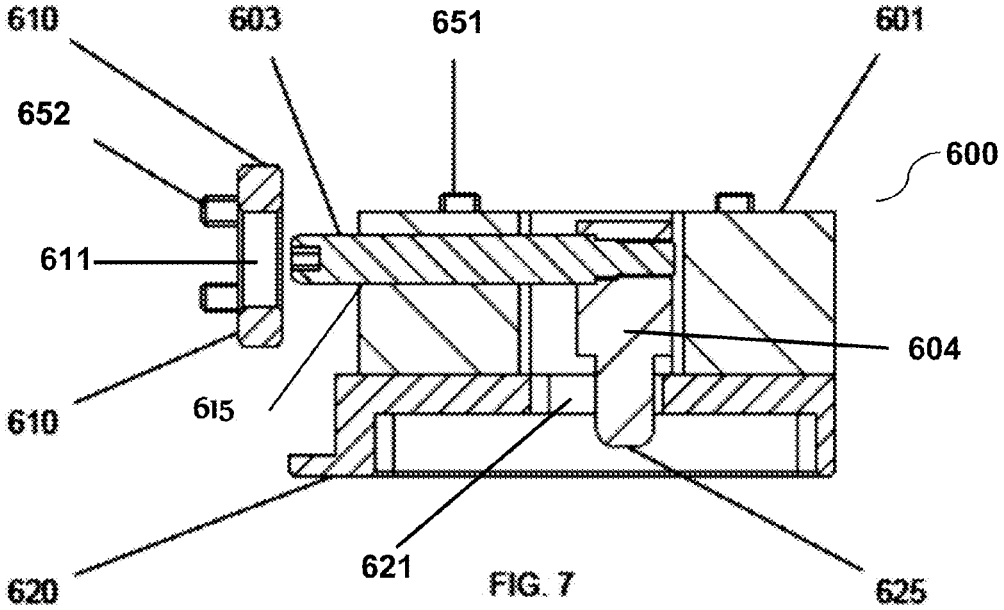
FIG. 7, shows a bottom view of the locking mechanism and the strike plate in the open position.

As shown in FIGS. 6A, 6B, 7, 8B, and 9, strike plate 610 defines an elongated vertical channel (see e.g. FIG. 8B), configured to engage bolt 603 and can allow some elevation of bolt 603 relative to strike plate 610 without disengaging bolt 603. As shown in FIG. 7, showing a top view of locking assembly 600, illustrating that bolt 603 extends beyond access bore 615. Bolt 603, can be coupled to connector 604 for example, by screwing bolt 603 into a threaded bore in connector 604. As shown in FIG. 7, bolt 603 is disposed perpendicular to the sliding direction of window/door pane 101 (See e.g., FIGS. 1A, 1B, 1C, and 6B).

Figure 8A:
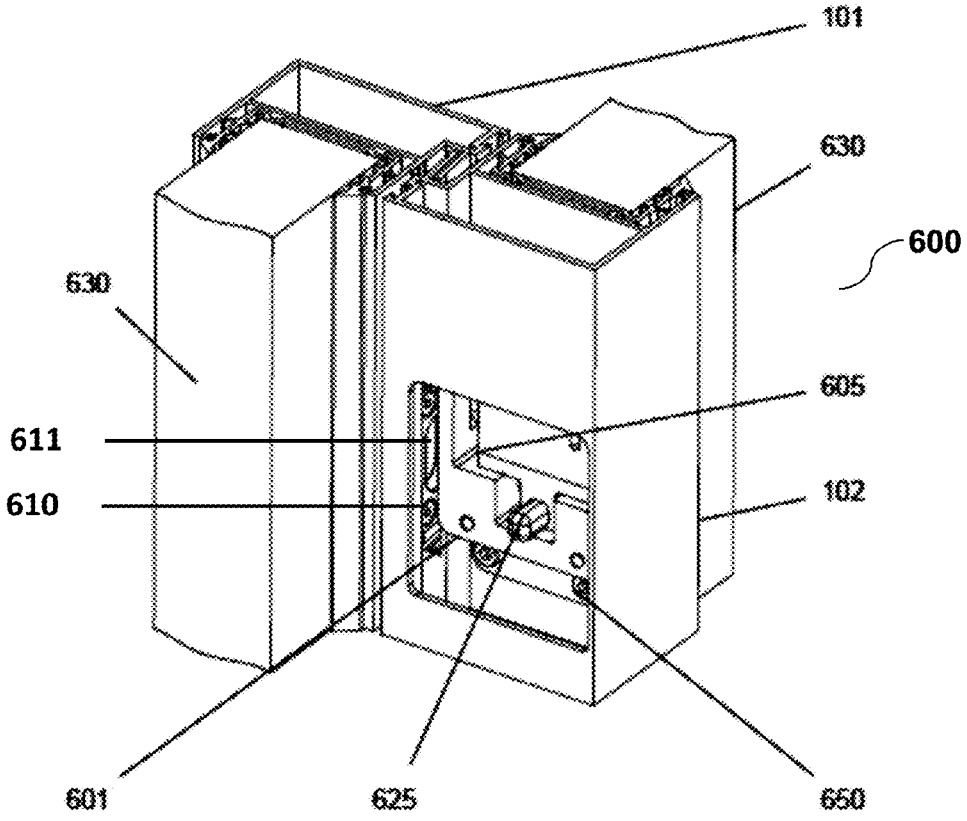
FIGS. 8A and 8B, shows the front perspective (FIG. 8A) of the locking mechanism, with FIG. 8B showing the rear perspective.
Figure 8B:
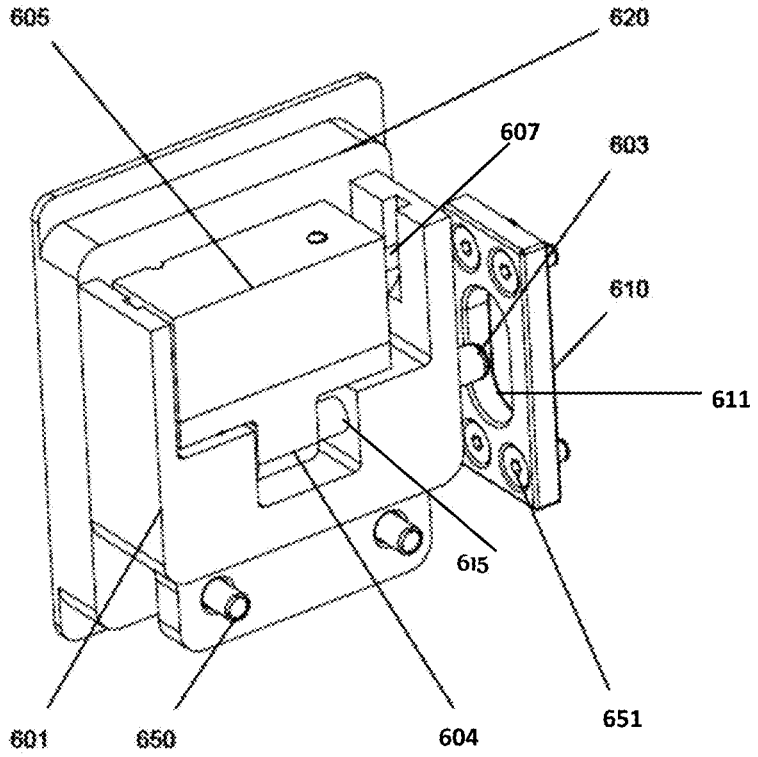
Figure 9:
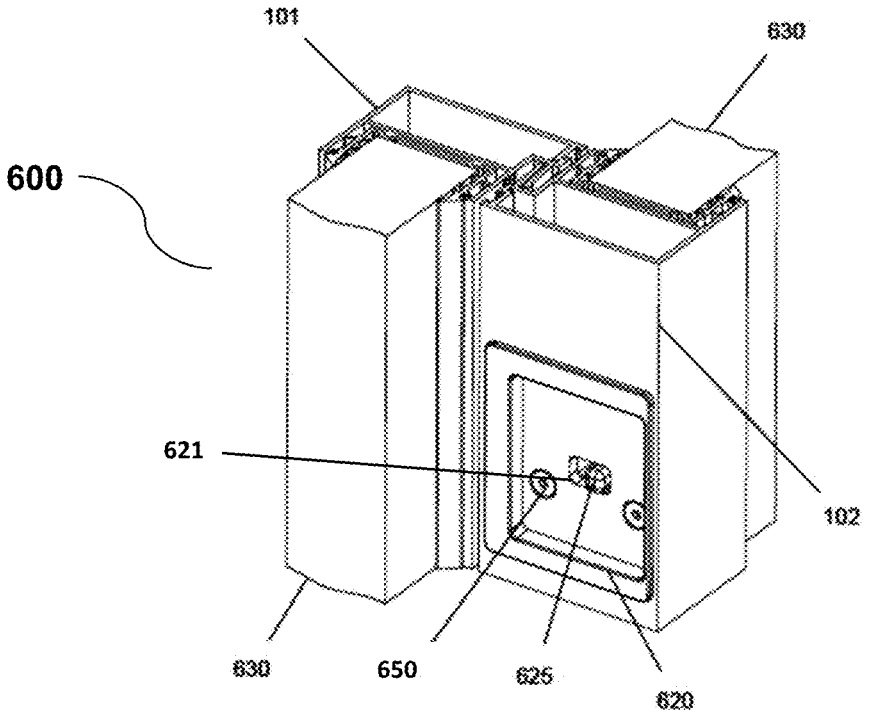
FIG. 9, shows the locking assembly embedded within the closure frame.

Turning now to FIG. 8A, showing locking mechanism 600 without face plate 620 during installation using the kits described herein, where housing 601 is coupled to closure pane frame 102 using coupling means 650, for example screws. As shown in FIG. 8B, backward actuator 607 is engaged by solenoid 605, sliding bolt 603 backwards from strike plate 610 unlocking closure pane frame 101 from closure pane frame 102, or from the opening frame (sill). Upon receipt of a locking command from the CCM (see e.g., FIG. 14), either through internal control panel, or the remote control, solenoid 605 will activate forward actuator 606 (not shown) to extend against housing 601, causing bolt 603 to slide in access bore 615 and engage strike plate 610, locking closure pane frame 101 to closure pane frame 102, or the opening frame (sill). Locking assembly 600 can be powered by proper wiring embedded within closure frame 101.

In an embodiment, provided herein is a drivetrain for a motorized opening assembly, comprising: a leveling assembly; and a mobilizing assembly, wherein the mobilizing assembly comprises: a driver; a clutch; a gear box; and a track wheel coupled to the gear box, the track wheel configured to engage a rail, wherein, (viii) the drivetrain is embedded within a frame of a substantially rectangular closure slab surrounded by the closure slab frame and sealingly fit within an opening frame; (ix) the closure slab train further comprises at least one more drivetrain; (x) the gearbox comprises: a beveled gear; and at least one spur gear, wherein the at least one spur gear is operably coupled to the track wheel, the track wheel configured to engage a rail on the opening frame; (xi) the substantially rectangular closure slab comprises: an inner pane; and an outer pane; (xii) each of the inner pane and outer pane comprise a pane frame; (xiii) the frame each of the inner pane, and outer pane comprises a first dedicated drivetrain and a second dedicated drivetrain disposed on opposite horizontal end of the pane frame; and (xiv) each of the mobilizing assembly of the first drivetrain and the second drivetrain is hingedly coupled to the slab frame. The term "hingedly coupled" means any manner of engagement between a first part relative to a second part which allows the first part to travel relative to the second part without the first part becoming disengaged from the second part and by way of example without limiting the forgoing includes a jointed or flexible device that connects two parts such as the mobilizing assembly and the closure or pane frame allowing rotation between them and by way of non-limiting example includes pivot hinges, continuous hinges, barrel hinges, butt hinges, tee hinges, a flexible sheet material, or the like.

In yet another embodiment, provided herein is a kit for enabling slidably moving a closure slab between an open position and a closed position, the kit comprising: a drivetrain comprising a leveling assembly and a mobilizing assembly, wherein the mobilizing assembly comprises: a driver; optionally a clutch; a gear box; and a track wheel coupled to the gear box, the track wheel configured to engage a rail; a locking assembly comprising: a locking mechanism comprising: a MEMS device comprising a faceplate, the faceplate defining an elongated horizontal slot; a housing coupled to the face plate, the housing defining an access bore spanning the width of the housing; a bolt slidably coupled to the housing within the access bore; a locking pin operably coupled to the bolt, the locking pin extending through the access bore beyond the housing; a connector operably coupled to the bolt; a solenoid, configured to engage a forward actuator and a backward actuator in response to a signal, the solenoid operably coupled to the connector; a forward and backward actuators; and a manual override tab operably coupled to the connector extending through the horizontal slot in the faceplate; and a strike plate, configured to engage the locking pin within a vertically elongated elliptical channel defined therein, wherein the locking mechanism capable of communicating with a command and control module; command and control module, comprising an internal control panel; the internal control panel comprising: a user interface; a processor; a sensor configured to detect a user's motion, wherein the user's motion is operable to provide a signal; and optionally a transceiver, wherein the control panel is configured to communicate with the drivetrain, the locking assembly, or both; optionally packaging; and optionally instructions, wherein (xv) the drivetrain is embedded within a frame of a substantially rectangular closure slab surrounded by the closure slab frame, (xvi) the closure slab frame further comprises at least one more of the drivetrain, (xvii) wherein the gearbox comprises: a beveled gear; and at least one spur gear, wherein the at least one spur gear is operably coupled to the track wheel, the track wheel configured to engage a rail on the opening frame, (xviii) the substantially rectangular closure slab comprises: an inner pane; and an outer pane, (xix) wherein each of the inner pane and outer pane comprise a pane frame, (xx) wherein each drivetrain is configured to be hingedly coupled to the slab frame, (xxi) the kit further comprising a first closure slab frame or a portion thereof, (xxii) wherein the MEMS device further comprises a connector pin coupling the connector to the bolt, (xxiii) the drivetrain is embedded within the first closure slab frame or portion thereof, (xxiv) the kit further comprising a second closure slab frame or a portion thereof, (xxv) wherein the strike plate is coupled to the second closure slab frame or a portion thereof, (xxvi) the MEMS device mechanism is coupled to the second closure slab frame or a portion thereof, (xxvii) the internal control panel is operably coupled to the first or second closure slab frame or a portion thereof, (xxviii) the internal control panel, an external control panel or both further comprises motion circuitry carried by the internal controlled panel, external control panel or both and operably coupled to the processor and motion sensor, the processor comprising a library of command motions stored thereon, (xxix) comprising first command motions and second command motions, (xxx) wherein the first command motion is configured to engage the forward actuator, and (xxxi) the second command motion is configured to engage the backward actuator, wherein (xxxii) the motion sensor is configured to sense hand speed across the sensor.

Further provided is a motorized closure assembly, comprising: an opening frame configured to fit around the opening; a substantially rectangular closure slab having a closure slab frame configured to surround the substantially rectangular closure slab and sealingly fit within the opening frame; and a motorized driver, wherein the motorized closure assembly is entirely embedded within the closure slab frame or within a combination of the closure slab frame and the opening frame.

While in the foregoing specification the motorized closures has been described in relation to certain preferred embodiments, and many details are set forth for purpose of illustration, it will be apparent to those skilled in the art that the disclosure of the motorized closures is susceptible to additional embodiments and that certain of the details described in this specification and as are more fully delineated in the following claims can be varied considerably without departing from the basic principles of this invention.

We claim:

1. A kit for enabling slidably moving a closure slab between an open position and a closed position, the kit comprising:

(a) a drivetrain comprising:

a leveling assembly and a mobilizing assembly, wherein the mobilizing assembly comprises:

a driver; optionally a clutch;

a gear box; and a track wheel coupled to the gear box, the track wheel configured to engage a rail;

(b) a locking assembly comprising:

a locking mechanism comprising: a MEMS device comprising:

a faceplate, the faceplate defining an elongated horizontal slot;

a housing coupled to the face plate, the housing defining an access bore spanning the width of the housing;

a bolt slidably coupled to the housing within the access bore;

a locking pin operably coupled to the bolt, the locking pin extending through the access bore beyond the housing;

a connector operably coupled to the bolt;

a solenoid, configured to engage a forward actuator and a backward actuator in response to a signal, the solenoid operably coupled to the connector;

a forward and backward actuators; and a manual override tab operably coupled to the connector extending through the slot in the faceplate; and a strike plate, configured to engage the locking pin within a vertically elongated elliptical channel defined therein, wherein the locking mechanism capable of communicating with a command and control module;

(c) a command and control module comprising:

an internal control panel, the internal control panel comprising:

a user interface;

a processor;

a sensor configured to detect a user gesture, wherein the user gesture is operable to provide a signal; and optionally a transceiver, wherein the command and control module is configured to communicate with the drivetrain and/or locking assembly;

(d) optionally packaging; and (e) optionally instructions.

2. The kit of claim 1, wherein the drivetrain is embedded within a frame of a substantially rectangular closure slab surrounded by a closure slab frame.

3. The kit of claim 2, wherein the closure slab frame further comprises a second drivetrain embedded within the frame, the second drivetrain comprising a leveling assembly and a mobilizing assembly.

4. The kit of claim 3, wherein each of the mobilizing assembly of a first drivetrain and the second drivetrain is configured to be hingedly coupled to the slab frame.

5. The kit of claim 2, wherein the gearbox comprises:

a beveled gear; and at least one spur gear, wherein the at least one spur gear is operably coupled to the track wheel, the track wheel configured to engage a rail on the closure frame.

6. The kit of claim 2, wherein the substantially rectangular closure slab comprises:

an inner pane; and an outer pane.

7. The kit of claim 6, wherein each of the inner pane and outer pane comprise a pane frame.

8. The kit of claim 1, further comprising a first closure slab frame or a portion of the first closure slab frame.

9. The kit of claim 8, wherein the drivetrain is embedded within the first closure slab frame or portion of the first closure slab frame.

10. The kit of claim 9, further comprising a second closure slab frame or a portion of the second closure slab frame.

11. The kit of claim 10, wherein the strike plate is coupled to the second closure slab frame or a portion of the second closure slab frame.

12. The kit of claim 10, wherein the MEMS device mechanism is coupled to the second closure slab frame or a portion of the second closure slab frame.

13. The kit of claim 10, wherein the control panel is operably coupled to the first or second closure slab frame or a portion of the first or second closure slab frame.

14. The kit of claim 1, wherein the command and control module further comprises a remote control.

15. The kit of claim 1, wherein the internal control panel further comprises motion circuitry carried by the controlled panel and operably coupled to the processor and motion sensor, the processor comprising a library of command motions stored thereon.

16. The kit of claim 15, wherein the library of command motions comprising first command motions and second command motions.

17. The kit of claim 16, wherein the first command motion is configured to engage the forward actuator.

18. The kit of claim 16, wherein the second command motion is configured to engage the backward actuator.

19. The kit of claim 15, wherein the motion sensor is configured to sense hand speed across the sensor.

* * * * *